US010832628B2

(12) United States Patent
Liu et al.

(10) Patent No.: US 10,832,628 B2
(45) Date of Patent: Nov. 10, 2020

(54) GATE ON-STATE VOLTAGE SUPPLY UNIT, GATE ON-STATE VOLTAGE SUPPLY METHOD, DISPLAY DRIVING MODULE AND DISPLAY DEVICE

(71) Applicants: CHONGQING BOE OPTOELECTRONICS TECHNOLOGY CO., LTD., Chongqing (CN); BOE TECHNOLOGY GROUP CO., LTD., Beijing (CN)

(72) Inventors: Zhiyou Liu, Beijing (CN); Yihjen Hsu, Beijing (CN); Lijun Xiao, Beijing (CN); Shaohong Gao, Beijing (CN); Jinjia Luo, Beijing (CN); Yanan Zhao, Beijing (CN); Xiuqin Zhang, Beijing (CN)

(73) Assignees: CHONGQING BOE OPTOELECTRONICS TECHNOLOGY CO., LTD., Chongqing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/410,373

(22) Filed: May 13, 2019

(65) Prior Publication Data

US 2020/0013365 A1 Jan. 9, 2020

(30) Foreign Application Priority Data

Jul. 3, 2018 (CN) ..... 2018 1 0718286

(51) Int. Cl.
*G09G 3/36* (2006.01)

(52) U.S. Cl.
CPC ..... *G09G 3/3696* (2013.01); *G09G 3/3648* (2013.01); *G09G 2310/0264* (2013.01);
(Continued)

(58) Field of Classification Search
CPC ..... G09G 3/3696; G09G 3/3648; G09G 2310/0264; G09G 2320/0247; G09G 2330/027; G09G 3/3677; G09G 2300/0408
See application file for complete search history.

(56) References Cited

U.S. PATENT DOCUMENTS 6,166,726 A * 12/2000 Uchida ..... G09G 3/3696 345/204
6,633,274 B1 * 10/2003 Yokota ..... G09G 3/36 345/100
(Continued)

FOREIGN PATENT DOCUMENTS

CN 1845233 A 10/2006
CN 1991952 A 7/2007
(Continued)

OTHER PUBLICATIONS

First Office Action for Chinese Application No. 201810718286.5, dated Apr. 23, 2020, 8 Pages.

*Primary Examiner* — Amit Chatly
(74) *Attorney, Agent, or Firm* — Brooks Kushman P.C.

(57) ABSTRACT

The present disclosure provides a gate on-state voltage supply unit, a gate on-state voltage supply method, a display driving module and a display device. The gate on-state voltage supply unit is used in the display device including a display driving module. The gate on-state voltage supply unit includes a shutdown determination module and a voltage supply module. The shutdown determination module is configured to determine whether the display device has been shut down, and when the display device has been shut down,
(Continued)

transmit a boosting control signal to the voltage supply module. The voltage supply module is configured to, upon the receipt of the boosting control signal, boost a gate on-state voltage to acquire a boosted gate on-state voltage, and apply the boosted gate on-state voltage to a gate driving circuit of the display driving module.

16 Claims, 3 Drawing Sheets

(52) U.S. Cl.
CPC ..... *G09G 2320/0247* (2013.01); *G09G 2330/027* (2013.01)

(56) References Cited

U.S. PATENT DOCUMENTS

2003/0184538 A1* 10/2003 Yamato ..... G09G 3/3696 345/211
2006/0289893 A1* 12/2006 Lee ..... G09G 3/3677 257/147
2008/0303775 A1 12/2008 Guo et al.
2009/0066684 A1* 3/2009 Lee ..... G09G 3/3648 345/211
2012/0146985 A1* 6/2012 Lee ..... G09G 3/3614 345/212
2013/0321385 A1* 12/2013 Fujisawa ..... G09G 3/20 345/212
2016/0035308 A1* 2/2016 Ota ..... G09G 3/3688 345/211

FOREIGN PATENT DOCUMENTS

CN 101320171 A 12/2008
CN 101540149 A 9/2009
CN 101739967 A 6/2010
CN 105513549 A 4/2016
CN 106952628 A 7/2017
CN 108231022 A 6/2018
JP 3030125 B2 4/2000

* cited by examiner

GATE ON-STATE VOLTAGE SUPPLY UNIT, GATE ON-STATE VOLTAGE SUPPLY METHOD, DISPLAY DRIVING MODULE AND DISPLAY DEVICE

CROSS-REFERENCE TO RELATED APPLICATION

This application claims priority to Chinese Patent Application No. 201810718286.5 filed on Jul. 3, 2018, which is incorporated herein by reference in its entirety.

TECHNICAL FIELD

The present disclosure relates to the field of display technology, in particular to a gate on-state voltage supply unit, a gate on-state voltage supply method, a display driving module and a display device.

BACKGROUND

Currently, along with the wide application of Liquid Crystal Display (LCD) products, a display panel with a Gate on Array (GOA) circuit has attracted more and more attentions due to a narrow bezel and low manufacture cost. For a GOA-based LCD panel, drift may occur for a characteristic of each Thin Film Transistor (TFT) in a GOA unit after long-term aging, and at this time a gate on-state voltage VGH for turning on the TFT may increase. When the display panel is powered off, the current gate on-state voltage VGH is insufficient to turn on all TFTs in the GOA units of the display panel, so it is impossible for the display panel to release charges completely. When the display panel is powered on and off frequently or powered off abnormally, the charges are not completely released, i.e., there are still residual charges, so such a phenomenon as flickering may occur.

SUMMARY

In one aspect, the present disclosure provides in some embodiments a gate on-state voltage supply unit for use in a display device. The display device includes a display driving module. The gate on-state voltage supply unit includes a shutdown determination module and a voltage supply module. The shutdown determination module is configured to determine whether the display device has been shut down, and when the display device has been shut down, transmit a boosting control signal to the voltage supply module. The voltage supply module is configured to, upon the receipt of the boosting control signal, boost a gate on-state voltage to acquire a boosted gate on-state voltage, and apply the boosted gate on-state voltage to a gate driving circuit of the display driving module.

In a possible embodiment of the present disclosure, the shutdown determination module is configured to determine that the display device has been shut down when a core voltage is at a falling edge, and transmit the boosting control signal to the voltage supply module. The core voltage is a voltage applied by a power source management integrated circuit of the display driving module to a timing controller of the display driving module.

In a possible embodiment of the present disclosure, the shutdown determination module includes a voltage detection sub-module, a first comparator, a second comparator, a phase inverter and an AND gate. The voltage detection sub-module is configured to detect the core voltage at a regular interval. A positive phase input end of the first comparator is configured to receive an $n^{th}$ core voltage detected by the voltage detection sub-module for the $n^{th}$ time, a negative phase input end of the first comparator is configured to receive a threshold core voltage, and an output end of the first comparator is connected to a first input end of the AND gate. The first comparator is configured to output a high level signal when the $n^{th}$ core voltage is greater than the threshold core voltage, and output a low level signal when the $n^{th}$ core voltage is smaller than the threshold core voltage, where n is a positive integer. A positive phase input end of the second comparator is configured to receive an $(n+1)^{th}$ core voltage detected by the voltage detection sub-module for the $(n+1)^{th}$ time, a negative phase input end of the second comparator is configured to receive the threshold core voltage, and an output end of the second comparator is connected to an input end of the phase inverter. The second comparator is configured to output a high level signal when the $(n+1)^{th}$ core voltage is greater than the threshold core voltage, and output a low level signal when the $(n+1)^{th}$ core voltage is smaller than the threshold core voltage. An output end of the phase inverter is connected to a second input end of the AND gate. The phase inverter is configured to output a low level signal when the input end of the phase inverter has received a high level signal, and output a high level signal when the input end of the phase inverter has received a low level signal. The AND gate is configured to output the boosting control signal via the output end of the AND gate when the first input end and the second input end of the AND gate have received a high level signal, and output a maintenance control signal via the output end of the AND gate when the first input end and/or the second input end of the AND gate have received a low level signal.

In a possible embodiment of the present disclosure, the voltage supply module further includes a boosting sub-module, an Enable end of which is connected to the output end of the AND gate. The boosting sub-module is configured to, upon the receipt of the boosting control signal via the Enable end, boost the gate on-state voltage from the power source management integrated circuit to acquire the boosted gate on-state voltage, and apply the boosted gate on-state voltage to the gate driving circuit. The boosting sub-module is further configured to, upon the receipt of the maintenance control signal via the Enable end, directly apply the gate on-state voltage from the power source management integrated circuit to the gate driving circuit.

In another aspect, the present disclosure provides in some embodiments a gate on-state voltage supply method for the above-mentioned gate on-state voltage supply unit, including: determining, by a shutdown determination module, whether a display device has been shut down, and applying a boosting control signal to a voltage supply module when the display device has been shut down; and upon the receipt of the boosting control signal, boosting, by the voltage supply module, a gate on-state voltage to acquire a boosted gate on-state voltage, and applying the boosted gate on-state voltage to a gate driving circuit of a display driving module.

In a possible embodiment of the present disclosure, the determining, by the shutdown determination module, whether the display device has been shut down and applying the boosting control signal to the voltage supply module when the display device has been shut down includes, when a core voltage is at a falling edge, determining, by the shutdown determination module, that the display device has been shut down, and applying the boosting control signal to the voltage supply module. The core voltage is a voltage applied by a power source management integrated circuit of the display driving module to a timing controller of the display driving module.

In yet another aspect, the present disclosure provides in some embodiments a display driving module including a gate driving circuit and the above-mentioned gate on-state voltage supply unit connected to the gate driving circuit.

In a possible embodiment of the present disclosure, the display driving module further includes a power source management integrated circuit and a timing controller. The power source management integrated circuit is configured to apply a core voltage to the timing controller, and apply a gate on-state voltage to a voltage supply module of the gate on-state voltage supply unit. A shutdown determination module of the gate on-state voltage supply unit is configured to determine that the display device has been shut down when the core voltage is at a falling edge, and apply a boosting control signal to the voltage supply module. The voltage supply module is configured to, upon the receipt of the boosting control signal, boost the gate on-state voltage to acquire a boosted gate on-state voltage, and apply the boosted gate on-state voltage to the gate driving circuit.

In a possible embodiment of the present disclosure, the shutdown determination module is arranged in the timing controller.

In still yet another aspect, the present disclosure provides in some embodiments a display device including the above-mentioned display driving module.

BRIEF DESCRIPTION OF THE DRAWINGS

In order to illustrate the technical solutions of the present disclosure or the related art in a clearer manner, the drawings desired for the present disclosure or the related art will be described hereinafter briefly. Obviously, the following drawings merely relate to some embodiments of the present disclosure, and based on these drawings, a person skilled in the art may obtain the other drawings without any creative effort.

DETAILED DESCRIPTION

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Figure 1:
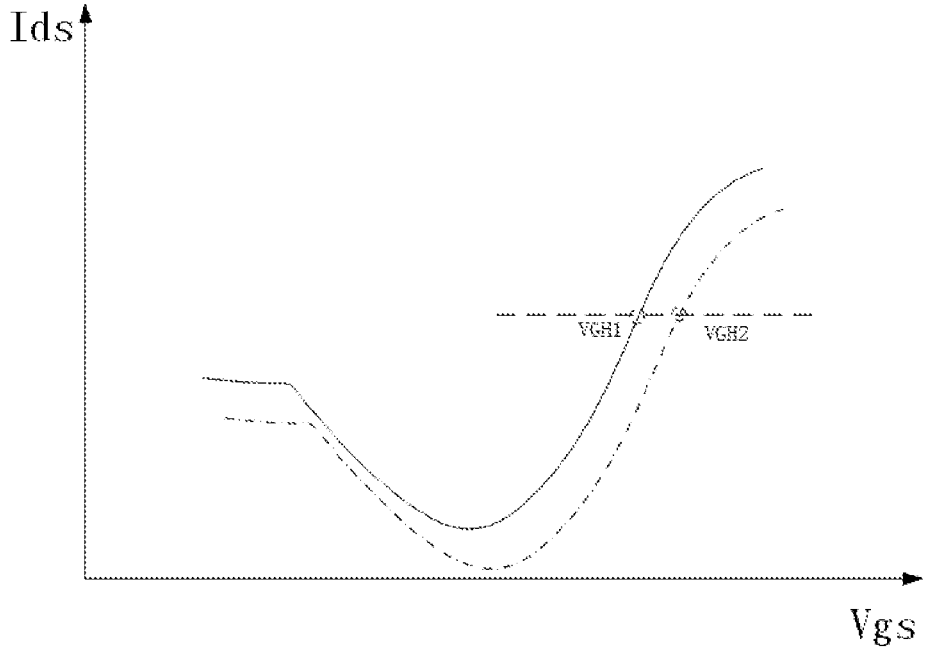
FIG. 1 is a curve diagram showing characteristic curves of a TFT in the related art.

In FIG. 1, a longitudinal axis represents a drain-to-source current Ids of a TFT, a horizontal axis represents a gate-to-source voltage Vgs of the TFT, a solid line represents a characteristic curve of the TFT in a normal state (i.e., the TFT which has not been aged yet), and a dotted line represents a characteristic curve of the TFT which has been aged. As shown in FIG. 1, for a same drain-to-source current Ids, the normal TFT has a gate on-state voltage of VGH1, and the aged TFT has a gate on-state voltage of VGH2 greater than VGH1.

In the related art, when a display device has been shut down, it is impossible to turn on all transistors of a gate driving circuit and release charges completely on a display panel of the display device (i.e., there are still residual charges), so such a phenomenon as flickering may occur. A main object of the present disclosure is to provide a gate on-stage voltage supply unit, a gate on-stage voltage supply method, a display driving module and a display device, so as to solve the above-mentioned problem.

All transistors adopted in the embodiments of the present disclosure may be TFTs, field effect transistors (FETs) or any other elements having an identical characteristic. In order to differentiate two electrodes other than a gate electrode from each other, one of the two electrodes is called as first electrode and the other is called as second electrode. In actual use, the first electrode may be a drain electrode while the second electrode may be a source electrode, or the first electrode may be a source electrode while the second electrode may be a drain electrode.

Figure 2:
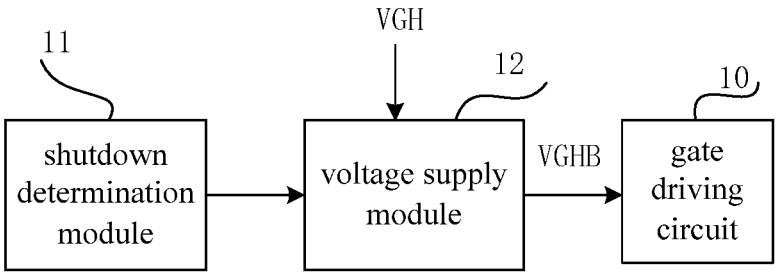
FIG. 2 is a schematic view showing a gate on-state voltage supply unit according to one embodiment of the present disclosure.

The present disclosure provides in some embodiments a gate on-stage voltage supply unit for use in a display device which includes a display driving module. As shown in FIG. 2, the gate on-stage voltage supply unit includes a shutdown determination module 11 and a voltage supply module 12. The shutdown determination module 11 is configured to determine whether the display device has been shut down, and when the display device has been shut down, transmit a boosting control signal to the voltage supply module 12. The voltage supply module 12 is configured to, upon the receipt of the boosting control signal, boost a gate on-state voltage VGH to acquire a boosted gate on-state voltage VGHB, and apply the boosted gate on-state voltage VGHB to a gate driving circuit 10 of the display driving module.

According to the gate on-stage voltage supply unit in the embodiments of the present disclosure, when the display device has been shut down, it is able to boost the gate on-state voltage, so as to turn on all transistors of the gate driving circuit, completely release charges in a display panel of the display device, and prevent the occurrence of residual charges, thereby to prevent the occurrence of flickering.

In actual use, the gate on-state voltage VGH is a maximum on-state voltage across a scanning line for turning on a transistor.

In addition, when the display device has not been shut down yet (i.e., the display device is operating normally), the gate on-state voltage supply unit may apply the gate on-state voltage VGH to the gate driving circuit. Also, when an operating characteristic of each TFT of the gate driving circuit is normal (i.e., the TFT has not been aged yet), the gate on-state voltage supply unit may apply the gate on-state voltage to the gate driving circuit.

To be specific, the shutdown determination module is configured to determine that the display device has been shut down when a core voltage is at a falling edge, and transmit the boosting control signal to the voltage supply module. The core voltage may be a voltage applied by a power source management integrated circuit of the display driving module to a timing controller of the display driving module.

In actual use, the power source management integrated circuit is configured to apply the core voltage VCORE to the timing controller, so as to enable the timing controller to operate normally. When the core voltage VCORE is at the falling edge, the shutdown determination module may determine that the display device is about to be shut down.

Figure 3:
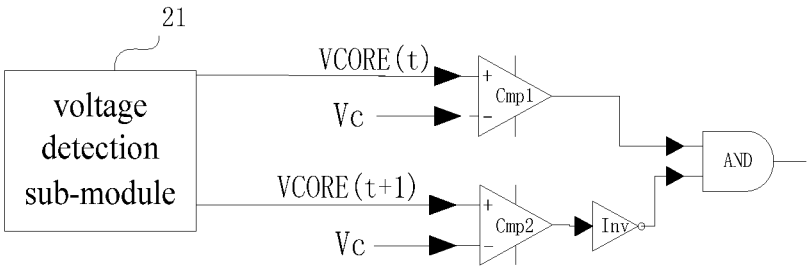
FIG. 3 is a schematic view showing a shutdown determination module of the gate on-state voltage supply unit according to one embodiment of the present disclosure.

During the implementation, as shown in FIG. 3, the shutdown determination module 11 may include a voltage detection sub-module 21, a first comparator Cmp1, a second comparator CMp2, a phase inverter Inv and an AND gate. The voltage detection sub-module 21 is configured to detect the core voltage at a regular interval. A positive phase input end of the first comparator Cmp1 may be configured to receive an $n^{th}$ core voltage VCORE (t) detected by the voltage detection sub-module 21 for the $n^{th}$ time, a negative phase input end of the first comparator Cmp1 may be configured to receive a threshold core voltage Vc, and an output end of the first comparator Cmp1 may be connected to a first input end of the AND gate. The first comparator Cmp1 is configured to output a high level signal when the $n^{th}$ core voltage VCORE (t) is greater than the threshold core voltage Vc, and output a low level signal when the $n^{th}$ core voltage VCORE (t) is smaller than the threshold core voltage Vc, where n is a positive integer. A positive phase input end of the second comparator Cmp2 may be configured to receive an $(n+1)^{th}$ core voltage VCORE (t+1) detected by the voltage detection sub-module 21 for the $(n+1)^{th}$ time, a negative phase input end of the second comparator Cmp2 may be configured to receive the threshold core voltage Vc, and an output end of the second comparator Cmp2 may be connected to an input end of the phase inverter Inv. The second comparator Cmp2 is configured to output a high level signal when the $(n+1)^{th}$ core voltage VCORE (t+1) is greater than the threshold core voltage Vc, and output a low level signal when the $(n+1)^{th}$ core voltage VCORE (t+1) is smaller than the threshold core voltage Vc. An output end of the phase inverter Inv may be connected to a second input end of the AND gate. The phase inverter Inv is configured to output a low level signal when the input end of the phase inverter Inv has received a high level signal, and output a high level signal when the input end of the phase inverter Inv has received a low level signal. The AND gate is configured to output the boosting control signal via the output end of the AND gate when the first input end and the second input end of the AND gate have received a high level signal (in FIG. 3, the boosting control signal is just the high level signal from the output end of the AND gate), and output a maintenance control signal via the output end of the AND gate when the first input end and/or the second input end of the AND gate have received a low level signal (in FIG. 3, the boosting control signal is just the low level signal from the output end of the AND gate).

To be specific, the threshold core voltage Vc may be, but not limited to, equal to 0.8*VCORED, and VCORED is a value of a core voltage applied by the power source management integrated circuit to the timing controller when the display device is operating normally.

Figure 4:
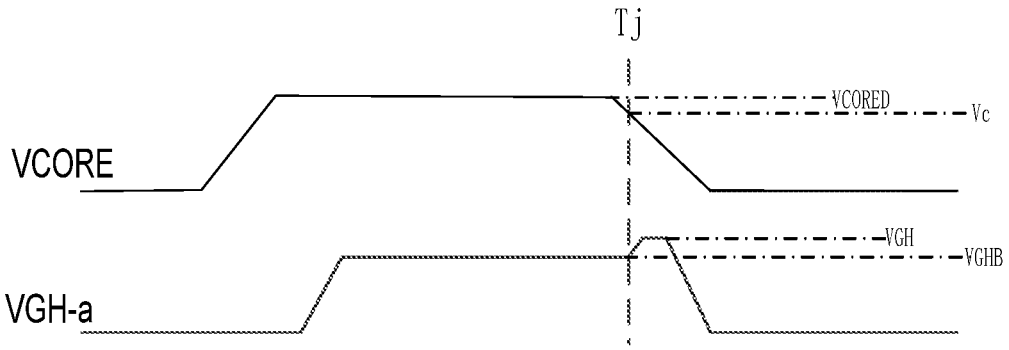
FIG. 4 is a schematic view showing a core voltage and an actual gate on-state voltage according to one embodiment of the present disclosure.

As shown in FIG. 4, at a time point Tj indicated by a dotted line, VCORE decreases from VCORED to Vc, and at this time, the AND gate may output the boosting control signal, so as to boost the gate on-state voltage VGH for the display panel in a normal operating state. In FIG. 4, VGH-a is a gate on-state voltage actually applied by the power source management integrated circuit, and VGHB represents a boosted gate on-state voltage.

Figure 5:
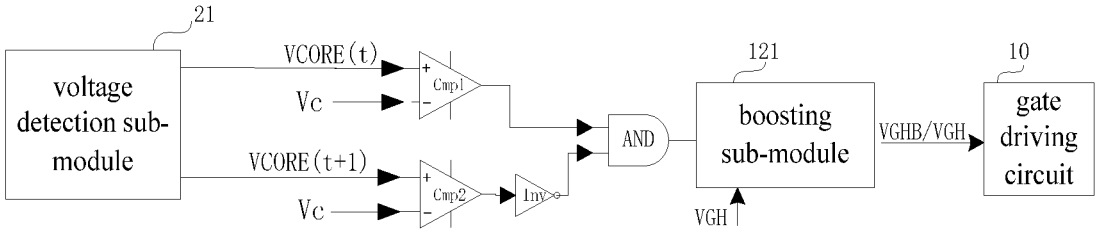
FIG. 5 is another schematic view showing the gate on-state voltage supply unit according to one embodiment of the present disclosure.

During the implementation, as shown in FIG. 5, on the basis of FIG. 3, the voltage supply module may further include a boosting sub-module 121, an Enable end of which is connected to the output end of the AND gate. The boosting sub-module 121 is configured to, upon the receipt of the boosting control signal via the Enable end, boost the gate on-state voltage VGH from the power source management integrated circuit (not shown) to acquire the boosted gate on-state voltage VGHB, and apply the boosted gate on-state voltage VGHB to the gate driving circuit 10. The boosting sub-module 121 is further configured to, upon the receipt of the maintenance control signal via the Enable end, directly apply the gate on-state voltage VGH from the power source management integrated circuit to the gate driving circuit 10.

Figure 6:
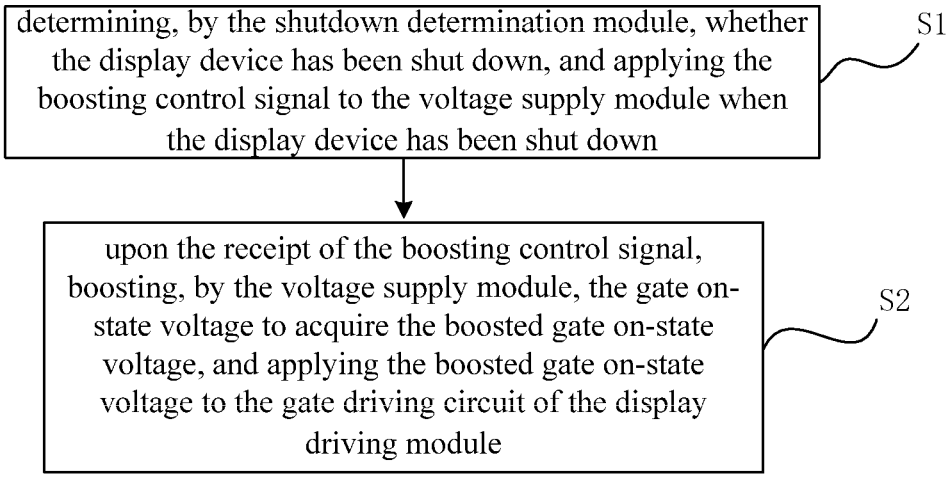
FIG. 6 is a flow chart of a gate on-state voltage supply method according to one embodiment of the present disclosure.

The present disclosure further provides in some embodiments a gate on-state voltage supply method for the above-mentioned gate on-state voltage supply unit, which, as shown in FIG. 6, includes: S1 of determining, by the shutdown determination module, whether the display device has been shut down, and applying the boosting control signal to the voltage supply module when the display device has been shut down; and S2 of, upon the receipt of the boosting control signal, boosting, by the voltage supply module, the gate on-state voltage to acquire the boosted gate on-state voltage, and applying the boosted gate on-state voltage to the gate driving circuit of the display driving module.

According to the gate on-stage voltage supply method in the embodiments of the present disclosure, when the display device has been shut down, it is able to boost the gate on-state voltage, so as to turn on all transistors of the gate driving circuit, completely release charges in a display panel of the display device, and prevent the occurrence of residual charges, thereby to prevent the occurrence of flickering.

To be specific, the determining, by the shutdown determination module, whether the display device has been shut down and applying the boosting control signal to the voltage supply module when the display device has been shut down may include, when a core voltage is at a falling edge, determining, by the shutdown determination module, that the display device has been shut down, and applying the boosting control signal to the voltage supply module. The core voltage may be a voltage applied by the power source management integrated circuit of the display driving module to the timing controller of the display driving module.

In actual use, the power source management integrated circuit is configured to apply the core voltage VCORE to the timing controller, so as to enable the timing controller to operate normally. When the core voltage VCORE is at the falling edge, the shutdown determination module may determine that the display device is about to be shut down.

The present disclosure further provides in some embodiments a display driving module, which includes a gate driving circuit and the above-mentioned gate on-state voltage supply unit connected to the gate driving circuit.

During the implementation, the display driving module may further include a power source management integrated circuit and a timing controller. The power source management integrated circuit is configured to apply a core voltage to the timing controller, and apply a gate on-state voltage to a voltage supply module of the gate on-state voltage supply unit. A shutdown determination module of the gate on-state voltage supply unit is configured to determine that the display device has been shut down when the core voltage is at a falling edge, and apply a boosting control signal to the voltage supply module. The voltage supply module is configured to, upon the receipt of the boosting control signal, boost the gate on-state voltage to acquire a boosted gate on-state voltage, and apply the boosted gate on-state voltage to the gate driving circuit.

To be specific, the shutdown determination module may be arranged in the timing controller.

The display driving circuit for use in the display device will be described hereinafter in more details.

Figure 7:
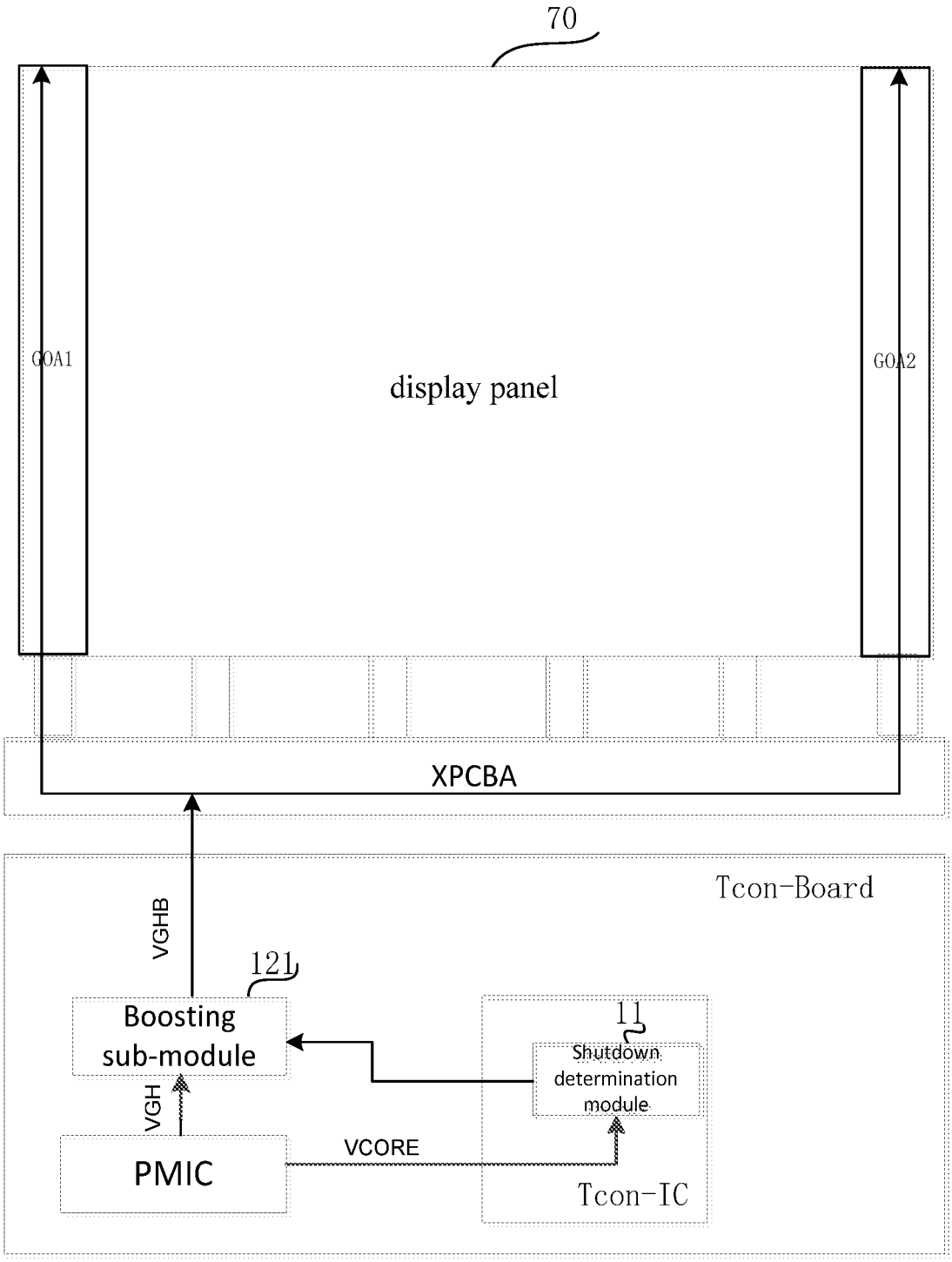
FIG. 7 is a schematic view showing a display device according to one embodiment of the present disclosure.

As shown in FIG. 7, the display device may include a display panel 70, a circuit board XPCBA arranged at a lower side of the display panel 70, a first gate driving circuit GOA1 arranged at a left side of the display panel 70, and a second gate driving circuit GOA2 arranged at a right side of the display panel 70. In FIG. 7, Tcon-Board represents a timing controller circuit board, PMIC represents a power source management integrated circuit, and Tcon-IC represents a timing controller. The shutdown determination module 11 is arranged in the timing controller Tcon-IC, and the voltage supply module includes the boosting sub-module 121, an Enable end of which is connected to the shutdown determination module 11. The boosting sub-module 121 is configured to, upon the receipt of the boosting control signal via the Enable end, boost the gate on-state voltage VGH from the power source management integrated circuit PMIC to acquire the boosted gate on-state voltage VGHB, and apply the boosted gate on-state voltage VGHB to the first gate driving circuit GOA1 and the second gate driving circuit GOA2.

The present disclosure further provides in some embodiments a display device including the above-mentioned display driving module.

The display device may be any product or member having a display function, e.g., mobile phone, flat-panel computer, television, display, laptop computer, digital photo frame or navigator.

According to the gate on-state voltage supply unit, the gate on-state voltage supply method, the display driving module and the display device in the embodiments of the present disclosure, as compared with the related art, when the display device has been shut down, it is able to boost the gate on-state voltage, so as to turn on all transistors of the gate driving circuit, completely release charges in a display panel of the display device, and prevent the occurrence of residual charges, thereby to prevent the occurrence of flickering.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A gate on-state voltage supply unit for use in a display device comprising a display driving module, the gate on-state voltage supply unit comprising a shutdown determination module and a voltage supply module, wherein the shutdown determination module is configured to determine whether the display device has been shut down, and when the display device has been shut down, transmit a boosting control signal to the voltage supply module; the voltage supply module is configured to, upon the receipt of the boosting control signal, boost a gate on-state voltage to acquire a boosted gate on-state voltage, and apply the boosted gate on-state voltage to a gate driving circuit of the display driving module; and wherein the shutdown determination module comprises a voltage detection sub-module, a first comparator, a second comparator, a phase inverter and an AND gate; the voltage detection sub-module is configured to detect the core voltage at a regular interval; a positive phase input end of the first comparator is configured to receive an n.sup.th core voltage detected by the voltage detection sub-module for the n.sup.th time, a negative phase input end of the first comparator is configured to receive a threshold core voltage, and an output end of the first comparator is connected to a first input end of the AND gate; the first comparator is configured to output a high level signal when the n.sup.th core voltage is greater than the threshold core voltage, and output a low level signal when the n.sup.th core voltage is smaller than the threshold core voltage, where n is a positive integer; a positive phase input end of the second comparator is configured to receive an (n+1).sup.th core voltage detected by the voltage detection sub-module for the (n+1).sup.th time, a negative phase input end of the second comparator is configured to receive the threshold core voltage, and an output end of the second comparator is connected to an input end of the phase inverter; the second comparator is configured to output a high level signal when the (n+.sup.1).sup.th core voltage is greater than the threshold core voltage, and output a low level signal when the (n+1).sup.th core voltage is smaller than the threshold core voltage; an output end of the phase inverter is connected to a second input end of the AND gate; the phase inverter is configured to output a low level signal when the input end of the phase inverter has received a high level signal, and output a high level signal when the input end of the phase inverter has received a low level signal; and the AND gate is configured to output the boosting control signal via the output end of the AND gate when the first input end and the second input end of the AND gate have received a high level signal, and output a maintenance control signal via the output end of the AND gate when the first input end and/or the second input end of the AND gate have received a low level signal.

2. The gate on-state voltage supply unit according to claim 1, wherein the shutdown determination module is configured to determine that the display device has been shut down when a core voltage is at a falling edge, and transmit the boosting control signal to the voltage supply module, and the core voltage is a voltage applied by a power source management integrated circuit of the display driving module to a timing controller of the display driving module.

3. The gate on-state voltage supply unit according to claim 1, wherein the voltage supply module further comprises a boosting sub-module, an Enable end of which is connected to the output end of the AND gate; the boosting sub-module is configured to, upon the receipt of the boosting control signal via the Enable end, boost the gate on-state voltage from the power source management integrated circuit to acquire the boosted gate on-state voltage, and apply the boosted gate on-state voltage to the gate driving circuit; and the boosting sub-module is further configured to, upon the receipt of the maintenance control signal via the Enable end, directly apply the gate on-state voltage from the power source management integrated circuit to the gate driving circuit.

4. A gate on-state voltage supply method for using the gate on-state voltage supply unit according to claim 1, comprising:

determining, by the shutdown determination module, whether a display device has been shut down, and applying a boosting control signal to a voltage supply module when the display device has been shut down; and upon the receipt of the boosting control signal, boosting, by the voltage supply module, a gate on-state voltage to acquire a boosted gate on-state voltage, and applying the boosted gate on-state voltage to a gate driving circuit of a display driving module.

5. The gate on-state voltage supply method according to claim 4, wherein the determining, by the shutdown determination module, whether the display device has been shut down and applying the boosting control signal to the voltage supply module when the display device has been shut down comprises:

when a core voltage is at a falling edge, determining, by the shutdown determination module, that the display device has been shut down, and applying the boosting control signal to the voltage supply module, wherein the core voltage is a voltage applied by a power source management integrated circuit of the display driving module to a timing controller of the display driving module.

6. The gate on-state voltage supply method according to claim 5, further comprising:

detecting, by a voltage detection sub-module, the core voltage at a regular interval;

supplying an $n^{th}$ core voltage detected by the voltage detection sub-module for the $n^{th}$ time to a positive phase input end of a first comparator, supplying a threshold core voltage to a negative phase input end of the first comparator, and connecting an output end of the first comparator to a first input end of an AND gate; wherein the first comparator is configured to outputting a high level signal when the $n^{th}$ core voltage is greater than the threshold core voltage, and output a low level signal when the $n^{th}$ core voltage is smaller than the threshold core voltage, where n is a positive integer;

supplying an $(n+1)^{th}$ core voltage detected by the voltage detection sub-module for the $(n+1)^{th}$ time to a positive phase input end of a second comparator, supplying the threshold core voltage to a negative phase input end of the second comparator, and connecting an output end of the second comparator to an input end of a phase inverter; wherein the second comparator is configured to output a high level signal when the $(n+1)^{th}$ core voltage is greater than the threshold core voltage, and output a low level signal when the $(n+1)^{th}$ core voltage is smaller than the threshold core voltage;

connecting an output end of the phase inverter to a second input end of the AND gate; wherein the phase inverter is configured to output a low level signal when the input end of the phase inverter has received a high level signal, and output a high level signal when the input end of the phase inverter has received a low level signal; and outputting the boosting control signal via the output end of the AND gate when the first input end and the second input end of the AND gate have received a high level signal, and outputting a maintenance control signal via the output end of the AND gate when the first input end and/or the second input end of the AND gate have received a low level signal.

7. The gate on-state voltage supply method according to claim 6, further comprising:

connecting an Enable end of the boosting sub-module to the output end of the AND gate; wherein the boosting sub-module is configured to, upon the receipt of the boosting control signal via the Enable end, boost the gate on-state voltage from the power source management integrated circuit to acquire the boosted gate on-state voltage, and apply the boosted gate on-state voltage to the gate driving circuit; and the boosting sub-module is further configured to, upon the receipt of the maintenance control signal via the Enable end, directly apply the gate on-state voltage from the power source management integrated circuit to the gate driving circuit.

8. A display driving module comprising a gate driving circuit, and the gate on-state voltage supply unit according to claim 1 and connected to the gate driving circuit.

9. The display driving module according to claim 8, wherein the shutdown determination module is configured to determine that the display device has been shut down when a core voltage is at a falling edge, and transmit the boosting control signal to the voltage supply module, and the core voltage is a voltage applied by a power source management integrated circuit of the display driving module to a timing controller of the display driving module.

10. The display driving module according to claim 9, wherein the shutdown determination module comprises a voltage detection sub-module, a first comparator, a second comparator, a phase inverter and an AND gate;

the voltage detection sub-module is configured to detect the core voltage at a regular interval;

a positive phase input end of the first comparator is configured to receive an $n^{th}$ core voltage detected by the voltage detection sub-module for the $n^{th}$ time, a negative phase input end of the first comparator is configured to receive a threshold core voltage, and an output end of the first comparator is connected to a first input end of the AND gate;

the first comparator is configured to output a high level signal when the $n^{th}$ core voltage is greater than the threshold core voltage, and output a low level signal when the $n^{th}$ core voltage is smaller than the threshold core voltage, where n is a positive integer;

a positive phase input end of the second comparator is configured to receive an $(n+1)^{th}$ core voltage detected by the voltage detection sub-module for the $(n+1)^{th}$ time, a negative phase input end of the second comparator is configured to receive the threshold core voltage, and an output end of the second comparator is connected to an input end of the phase inverter;

the second comparator is configured to output a high level signal when the $(n+1)^{th}$ core voltage is greater than the threshold core voltage, and output a low level signal when the $(n+1)^{th}$ core voltage is smaller than the threshold core voltage;

an output end of the phase inverter is connected to a second input end of the AND gate;

the phase inverter is configured to output a low level signal when the input end of the phase inverter has received a high level signal, and output a high level signal when the input end of the phase inverter has received a low level signal; and the AND gate is configured to output the boosting control signal via the output end of the AND gate when the first input end and the second input end of the AND gate have received a high level signal, and output a maintenance control signal via the output end of the AND gate when the first input end and/or the second input end of the AND gate have received a low level signal.

11. The display driving module according to claim 10, wherein the voltage supply module further comprises a boosting sub-module, an Enable end of which is connected to the output end of the AND gate;

the boosting sub-module is configured to, upon the receipt of the boosting control signal via the Enable end, boost the gate on-state voltage from the power source management integrated circuit to acquire the boosted gate on-state voltage, and apply the boosted gate on-state voltage to the gate driving circuit; and the boosting sub-module is further configured to, upon the receipt of the maintenance control signal via the Enable end, directly apply the gate on-state voltage from the power source management integrated circuit to the gate driving circuit.

12. The display driving module according to claim 8, further comprising a power source management integrated circuit and a timing controller, wherein the power source management integrated circuit is configured to apply a core voltage to the timing controller, and apply a gate on-state voltage to a voltage supply module of the gate on-state voltage supply unit;

a shutdown determination module of the gate on-state voltage supply unit is configured to determine that the display device has been shut down when the core voltage is at a falling edge, and apply a boosting control signal to the voltage supply module; and the voltage supply module is configured to, upon the receipt of the boosting control signal, boost the gate on-state voltage to acquire a boosted gate on-state voltage, and apply the boosted gate on-state voltage to the gate driving circuit.

13. The display driving module according to claim 12, wherein the shutdown determination module is arranged in the timing controller.

14. A display device, comprising the display driving module according to claim 8.

15. The display device according to claim 14, wherein the display driving module further comprises a power source management integrated circuit and a timing controller, wherein the power source management integrated circuit is configured to apply a core voltage to the timing controller, and apply a gate on-state voltage to a voltage supply module of the gate on-state voltage supply unit;

a shutdown determination module of the gate on-state voltage supply unit is configured to determine that the display device has been shut down when the core voltage is at a falling edge, and apply a boosting control signal to the voltage supply module; and the voltage supply module is configured to, upon the receipt of the boosting control signal, boost the gate on-state voltage to acquire a boosted gate on-state voltage, and apply the boosted gate on-state voltage to the gate driving circuit.

16. The display device according to claim 15, wherein the shutdown determination module is arranged in the timing controller.

* * * * *